United States Patent [19]

Wu et al.

[11] Patent Number: 4,939,327

[45] Date of Patent: Jul. 3, 1990

[54] KEYBOARD SWITCH

[75] Inventors: Win Wu, Taipei; Ben Liao, Pan Chiau; K. H. Lee, Taipei Hsieng, all of China

[73] Assignee: Acer Incorporated, China

[21] Appl. No.: 265,054

[22] Filed: Oct. 31, 1988

[51] Int. Cl.[5] ..... H01H 1/10

[52] U.S. Cl. ..... 200/517; 200/341; 400/491.3

[58] Field of Search ..... 200/520, 521, 512, 559, 200/560, 341, 308, 329, 517; 400/490, 491.2, 491.3

[56] References Cited

U.S. PATENT DOCUMENTS

| | | | |
|---|---|---|---|
| 3,305,658 | 2/1967 | Heyhal | 200/295 |
| 3,311,731 | 3/1967 | Koepke | 200/295 |
| 4,000,389 | 12/1976 | Misson et al. | 200/517 |
| 4,080,522 | 3/1978 | Schimmels | 200/295 |
| 4,479,040 | 10/1984 | Denley et al. | 200/517 |
| 4,553,009 | 11/1985 | Van Zeeland et al. | 200/517 |
| 4,642,433 | 2/1987 | Murata | 200/521 |

*Primary Examiner*—Henry J. Recla
*Assistant Examiner*—Glenn T. Barrett
*Attorney, Agent, or Firm*—Andrus, Sceales, Starke & Sawall

[57] ABSTRACT

A keyboard switch for use with a membrane switch array (20) to provide a tactile feeling and, optionally, a click sound comprises a housing (10) which is positioned on the membrane switch array (20). A plunger (13) is reciprocally mounted within the housing (10) and projects outwardly from the housing, the plunger having a cam portion (133). An actuating arm (14) is pivoted to the housing (10) and has a first portion (141) extending beneath the plunger (13) and a second, cam follower portion (142) which engages the cam portion (133) of the plunger (13). The first portion (141) of the actuating arm (14) has a boss (1412) on its surface facing away from the plunger (13) for engaging the switch array (20). A compression spring (15) extends between the plunger (13) and the first portion 141 of the actuating arm (14) to urge the plunger (13) outwardly from the housing (10). A leaf spring (16) is mounted to the housing (10) and has a portion (161) which normally engages the plunger (13) whereby when the plunger is depressed into the housing (10) the boss (1412) on the actuating arm actuates the membrane switch and the plunger flexes the leaf spring to a point at which the spring snaps back to a rest position thereby providing a tactile feeling and, in certain cases, a click sound.

11 Claims, 5 Drawing Sheets

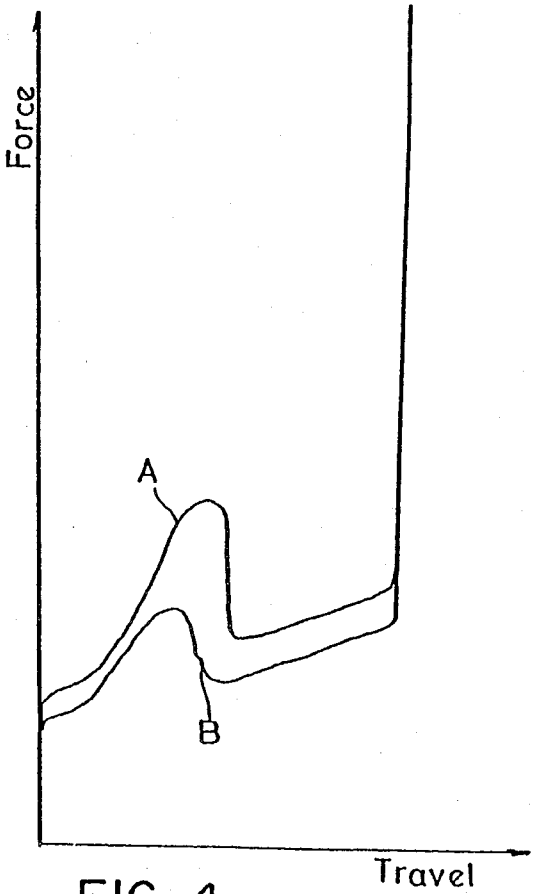
FIG. 4
FIG. 5A
PRIOR ART
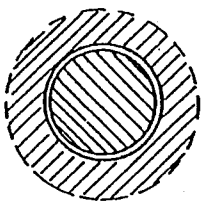
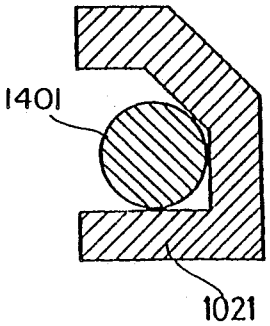
FIG. 5B
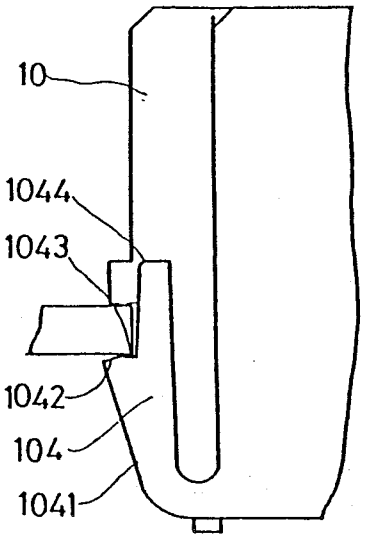
FIG. 3B

KEYBOARD SWITCH

The present invention relates to a keyboard switch, and particularly to a keyboard switch which can be used together with a membrane switch array.

US-A-4,553,009 discloses a switch which can be used together with a membrane switch array and wherein two embodiments are disclosed. The structure of the two embodiments disclosed is very complicated and not only increases the cost of manufacture but results in manufacturing difficulties. Above all, both embodiments disclosed cannot provide the tactile feeling required by key operators and the generally preferred click sound. This is why these constructions have still not achieved commercial success.

Most typists require some kind of feedback to confirm that a key has been correctly depressed. Such kinds of feedback can be divided into two types, one is audible and is generally called a click sound, and the other provides a resilient feeling to the finger, known as a tactile feeling. There are two commonly available structures which provide both a tactile feeling and a click sound, one of which is manufactured by Alps Electric Co, Ltd and which is disclosed in US-A-4,642,433. However, this can only be used with switches and cannot be applied to membrane switch arrays. In the Alps type, the tactile feeling and the click sound are generated by a leaf spring. During switch actuation the leaf spring is initially moved away from the side wall of the switch by the plunger and after a certain distance, the leaf spring bounces back to its initial position and strikes the side wall of the housing. Thus, the tactile feeling and click sound reach to the finger as well as to the ear of the typist.

The second type of mechanism which provides the tactile feeling and the click sound belongs to IBM. That structure is simpler and uses a single coil spring to generate the tactile feeling and click sound. But it cannot be used together with a membrane switch array, because it is also designed for use with mechanical switches.

In accordance with the present invention, a keyboard switch for use with a membrane switch array to provide a tactile feeling, comprises a housing positioned in use on the membrane switch array; a plunger reciprocally mounted within the housing and projecting outwardly from the housing, the plunger having a cam portion; an actuating arm pivoted to the housing and having a first portion extending beneath the plunger and a second, cam follower portion which engages the cam portion of the plunger, the first portion having a boss on its surface facing away from the plunger for engaging the switch array; resilient means extending between the plunger and the first portion of the actuating arm to urge the plunger outwardly from the housing; and a leaf spring mounted to the housing and having a portion which normally engages the plunger, the arrangement being such that when the plunger is depressed into the housing to cause the boss on the actuating arm to actuate the membrane switch the plunger flexes the leaf spring to a point at which the spring snaps back to a rest position thereby providing a tactile feeling.

In some cases, the switch may be adapted to operate silently since some typists prefer the tactile feeling without the click sound. In most cases, however, the snap action of the leaf spring is adapted to cause a click sound so that the keyboard switch provides tactile feeling and click sound.

Preferably, the housing further comprises a flexible stop means for retaining the plunger in the housing against the bias of the resilient means. Although most typists like the tactile feeling and the click sound some cannot accept the noises which occur as the finger is released from the keytop. As the finger leaves the keytop, the plunger will rebound to its original position and strike the ceiling of the housing with consequent noise. By providing a flexible stop, this problem is reduced or avoided.

The resilient means may comprise a block of resilient material but preferably the resilient means comprises a compression spring extending between facing seats on the plunger and the first portion of the actuating arm respectively.

Some examples of switches and membrane switch assemblies according to the invention will now be described and compared with conventional switches with reference to the accompanying drawings, in which:

FIG. 3B illustrates the hook arrangement of the switch;

FIG. 4 illustrates the variation of applied force vs travel of the plunger;

FIG. 5A illustrates the conventional manner in which an actuating arm shaft is mounted to the housing;

FIG. 5B is a sectional view illustrating the mounting of the shaft of the actuating arm to the housing in the switch of the present invention;

Figure 1:
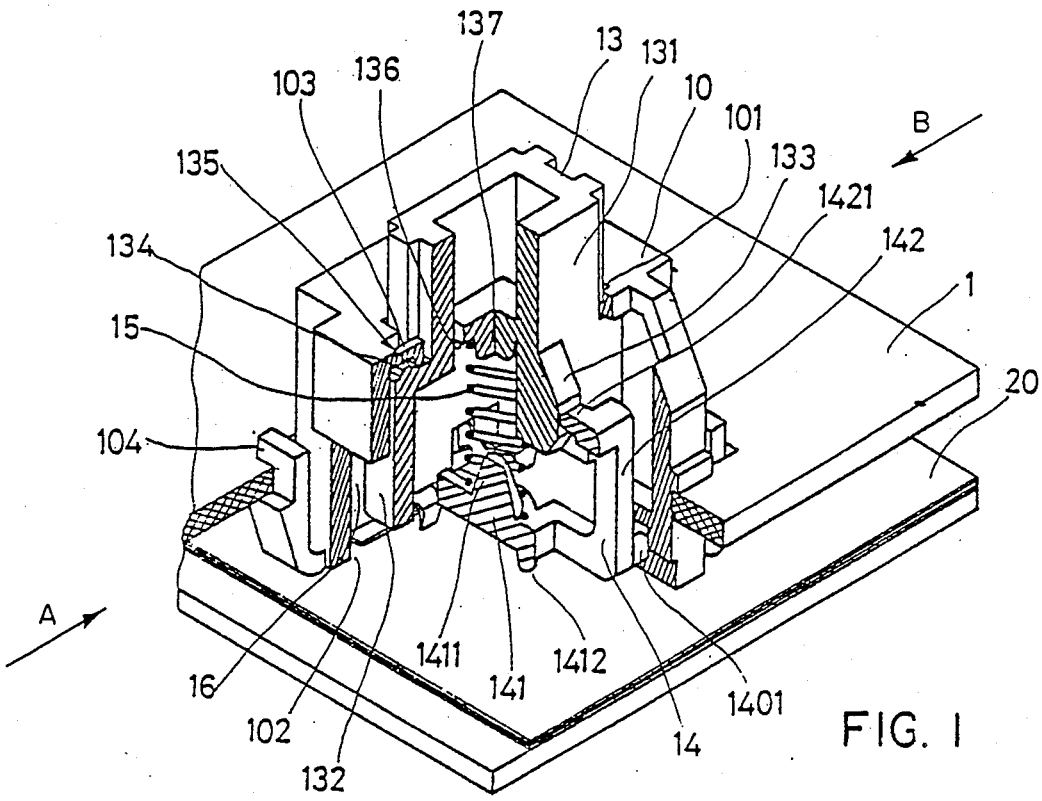
FIG. 1 is a perspective partly cut-away view of the first example.
Figure 9:
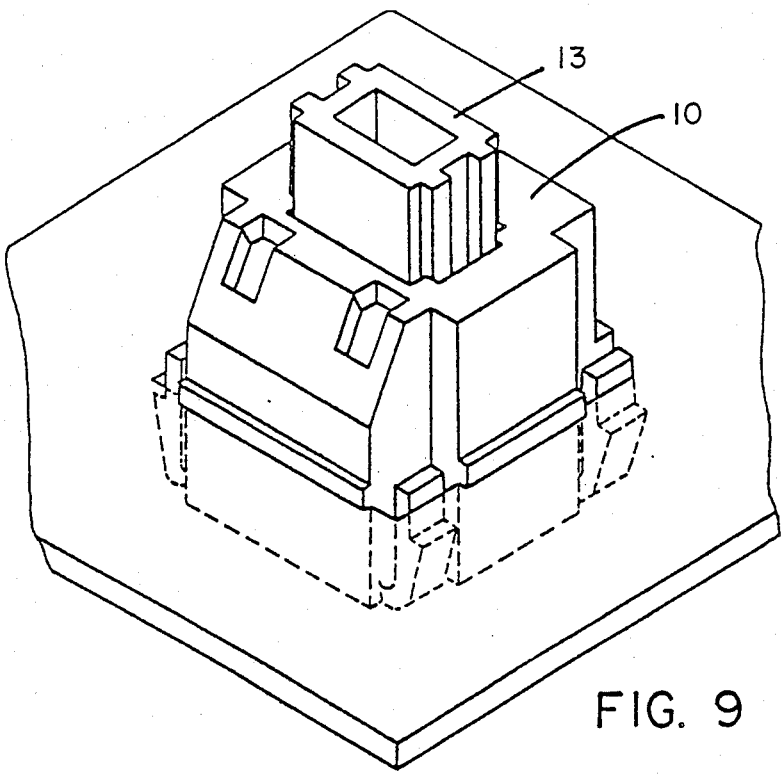

FIGS. 1 and 9 illustrate a first example of the switch which comprises a housing 10 having a rectangular first opening 101 on its top and a second opening 102 on the bottom. A flexible stop 103 is integrally formed with the housing 10 and extends inwardly of the first opening 101. A plunger 13 is mounted for movement upwardly and downwardly in the housing 10. The lower portion 132 of the plunger 13 has a cam 133 on its side wall. The size of the upper portion 131 of the plunger 13 is a little smaller than the first opening 101 which allows the upper portion 131 to project outwardly of the housing 10. The plunger 13 has a tapered plane 135 provided on a neck 134 defined at the junction between the upper and lower portions 131, 132. The tapered plane 135 will be stopped by the flexible stop 103 as the plunger 13 moves upwardly. This will decrease the noise which occurs as the neck 134 strikes the ceiling of the housing 10 during the return stroke of the plunger 13.

Figure 6A:
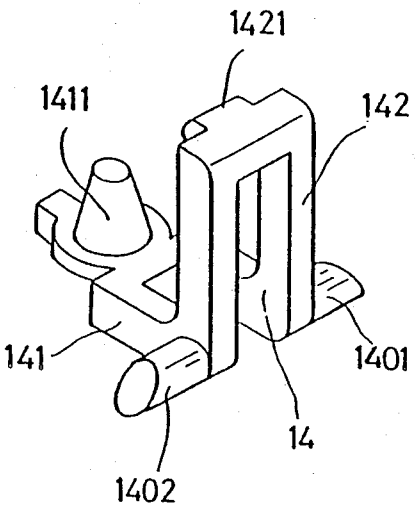
FIGS. 6A–6C are perspective views illustrating the actuating arm, the leaf spring and the plunger respectively.

The plunger 13 has an inside ceiling 136 with a downwardly facing first truncated seat 137. An actuating arm 14 is pivoted to a C-shaped support section 1021 of the second opening 102 of the housing 10 (FIG. 5B) by means of two shafts 1401 and 1402 (FIG. 6A). The actuating arm has a normally horizontal portion 141 extending inwardly and beneath the plunger 13 and a vertical or upright portion 142 extending upwardly and generally parallel to the plunger 13. The vertical portion 142 of the actuating arm 14 has a laterally extending projection 1421 on its upper end forming a cam follower which engages the cam 133 of the plunger 13. The horizontal portion 141 of the arm 14 has an upwardly facing truncated seat 1411 and a downwardly extending boss 1412 on its bottom surface.

A coil spring 15 is mounted between the first seat 137 and the second seat 1411 to urge the plunger 13 to move outwardly from the housing 10.

A plurality of hooks 104 are mounted on the outside wall of the housing 10 to enable the housing 10 to be positioned firmly on a metal support frame 1 (FIGS. 1 and 3B).

Figure 6C:
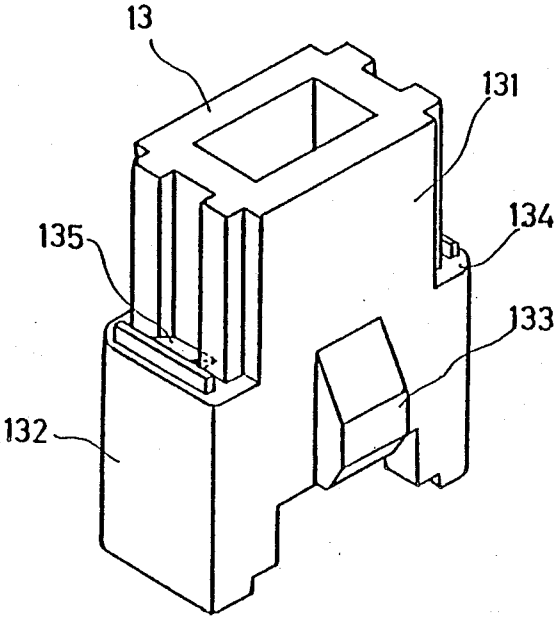
Figure 6B:
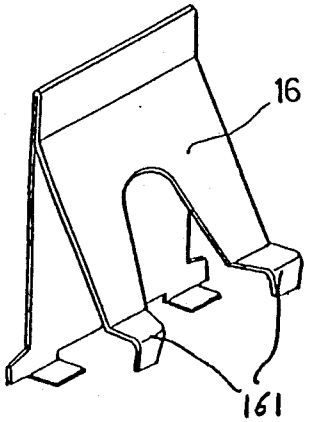

A leaf spring 16 (FIG. 6B) is mounted on the other side of the plunger 13 to provide the tactile feeling and the click sound.

Figure 2A:
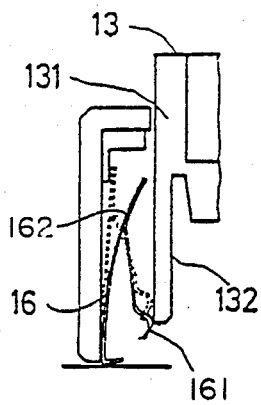
FIG. 2A is a sectional view in the direction A of part of the switch of FIG. 1 with the plunger depressed.
Figure 2B:
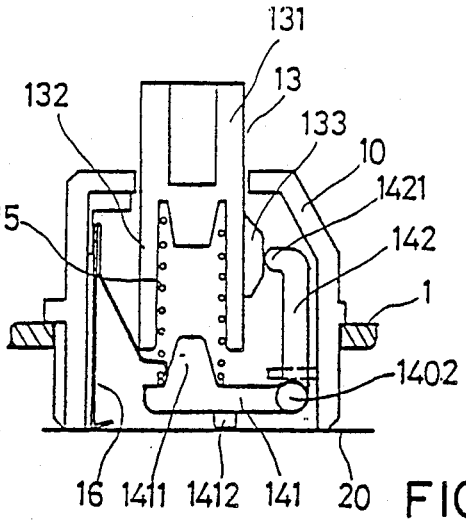
FIG. 2B is a sectional view in the direction A of the switch with the plunger in its rest position.

FIGS. 2A and 2B illustrate the relationship between the leaf spring 16 and the plunger 13. As the plunger 13 is depressed by the finger from its rest position shown in FIG. 2B, the tip 161 of the leaf spring 16 will be lowered by the end 132 of the plunger 13 and the upper portion 162 of the leaf spring 16 will be moved or flexed away from the side wall of the housing 10 (FIG. 2A). After the plunger 13 has moved a given distance, the tip 161 of the leaf spring 16 will slide over the end 132 of the plunger 13 and allow the leaf spring 16 to bounce or snap back to its original position, shown in the ghost line in FIG. 2A, striking the side wall of the housing 10 and producing a click sound. In the process of distortion of the leaf spring 16, tactile feeling is provided, and as it bounces back to its original position, the click sound is generated.

FIG. 2B illustrates the arrangement of the plunger 13, the coil spring 15, the actuating arm 14 and the leaf spring 16. FIG. 2B shows the horizontal portion 141 of the actuating arm 14 is right beneath the plunger 13 and the coil spring 15 is mounted between the first truncated seat 137 and the second truncated seat 1411. The leaf spring 16 is spaced to one side of the plunger 13 and the tip 161 of the leaf spring extends downwardly and beneath the lower portion 132 of the plunger 13. As the plunger 13 is pressed down by the finger, the horizontal portion 141 and the leaf spring 16 will be moved concurrently. After the plunger 13 moves downwardly to a given distance, the projection 1421 of said actuating arm 14 will slide over the upper edge of the cam 133 of the plunger 13 so that the arm 14 rotates about the shafts 1401, 1402. This will cause the boss 1412 to touch down on a membrane switch array 20 and complete the closing of the membrane switch which outputs a signal. As the plunger 13 is moving down, said leaf spring 16 will be moved concurrently, as shown in FIG. 2A. After the finger leaves the plunger 13, the coil spring 15 provides an upward force and urges the plunger 13 to return to its original position.

Figure 3A:
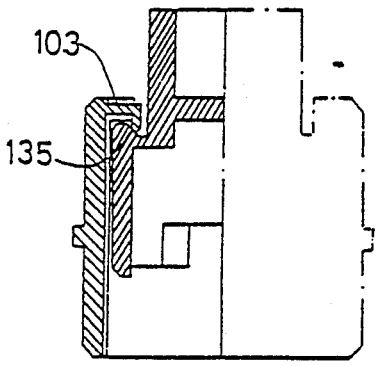
FIG. 3A is a part sectional view in the direction B in FIG. 1.

FIG. 3A shows that the flexible stop 103 contacts the tapered plane 135 when the plunger 13 is released. This will decrease the noise which occurs as the neck 134 of the plunger 13 (FIG. 6C) strikes the ceiling of the housing 10 and therefore provides a more quiet environment to the office.

FIG. 3B shows a hook 104 of the housing 10. The hook 104 is connected to the bottom of the housing 10. The hook 104 has a tapered surface 1041 and this allows the housing 10 to be easily installed into the metal frame 1. Each hook 104 has an engaging plane 1042 on the end of the tapered surface 1041 and a flat surface 1043 adjacent to the engaging surface 1042. As said housing 10 is installed into the metal frame 1, the flat surface 1042 will be forced to contact firmly with the bottom surface of the metal frame 1. The housing 10 will be firmly installed on the metal frame 1 unless the upper portion 1044 of each hook 104 is moved to the right (in FIG. 3B).

In FIG. 4 curve A relates to the downward movement and curve B relates to the upward movement of the plunger 13 separately. We find there is a difference in the sudden drop between the two curves A and B. That sudden drop will provide a positive feedback of tactile feeling to the finger. In the present case, the resilient force will drop from 60 grams to 45 and 25 grams separately, therefore the sudden drop is between 35 grams and 15 grams. The more difference the switch provides, the more positive tactile feeling we get.

FIG. 5B illustrates the manner in which the shafts of the actuating arm 14 are mounted to the housing 10 Unlike the prior art (FIG. 5A), the shafts reside in the support 1021 of the second opening 102. The shafts 1041, 1042 are not completely surrounded by the support 1021, but reside on the support 1021. This is entirely different from the prior art, shown in the FIG. 5A. This design provides a more flexible movement of the shaft 1041, 1042, to enable ease of assembly and maintenance.

Figure 7A:
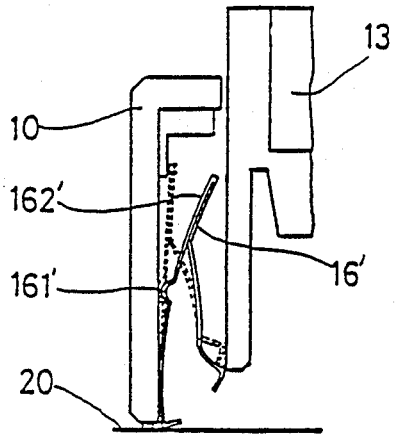
FIGS. 7A and 7B are part sectional views of a second example illustrating the plunger depressed and released positions respectively.
Figure 7B:
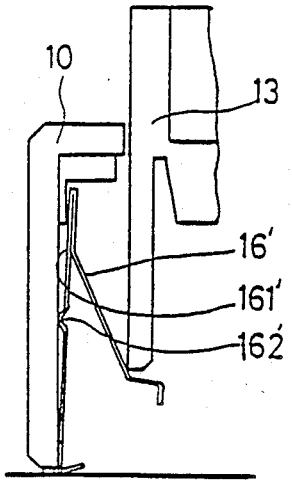

FIGS. 7A and 7B illustrate a second example in which a leaf spring 16' provides tactile feeling but a quieter click sound as compared with the first example. The leaf spring 16' has a projection 161' in its middle portion and the projection 161' will limit the force by which the upper portion 162' strikes the side wall of the housing as the leaf spring 16' snaps back from its flexed position (FIG. 7A) to its original position (FIG. 7B) so as to produce a quiet click sound.

Figure 8A:
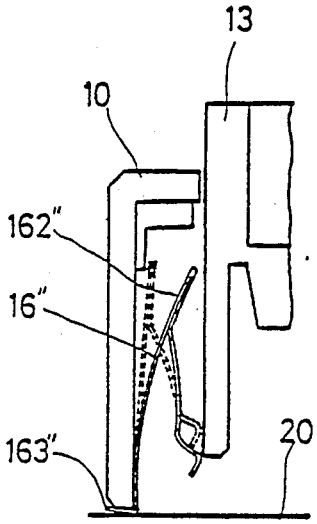
FIGS. 8A and 8B are views similar to FIGS. 7A and 7B but of a third example; and, FIG. 9 is a perspective view of the first example of the switch of the present invention.
Figure 8B:
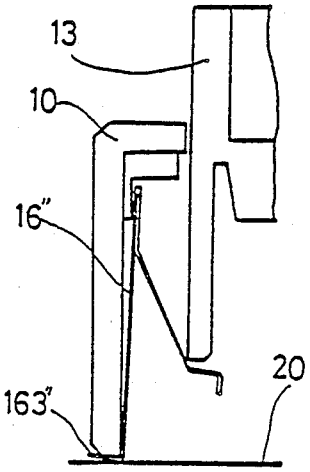

FIGS. 8A and 8B illustrate a third example of a switch with tactile feeling but entirely silent. In this example, the end 163'' of the leaf spring 16'' is fixed by the housing 10 so that the side wall of the housing 10 will not be stuck by the upper portion 162'' of the leaf spring 16'' as it returns from its flexed position (FIG. 8A) to its rest position (FIG. 8B). Therefore no click sound happens as the leaf spring 16'' bounce back from its distortion.

We claim:

1. A keyboard switch for use with a membrane switch array to provide a tactile feeling, the switch comprising:

a housing positioned, in use, on the membrane switch array;

a plunger mounted for reciprocal movement within the housing and projecting outwardly from the housing, the plunger having an exterior wall with a single cam portion extending outwardly therefrom normal to the direction of movement of the plunger, said cam portion having a generally rectangular camming surface, when viewed normal to the direction of movement of the plunger, with one dimension of said surface lying parallel to said direction of movement;

an actuating arm pivoted to the housing and having a first portion extending beneath the plunger, said actuating arm having a second portion having a single cam follower which engages said single cam portion of the plunger during both directions of the reciprocal movement of said plunger, the first portion having a boss on its surface facing away from the plunger for engaging the switch array;

resilient means extending between the plunger and the first portion of the actuating arm to urge the plunger outwardly from the housing; and a leaf spring mounted to the housing, said leaf spring having a rest position within said housing and a portion which normally engages the plunger, the arrangement of said switch being such that when the plunger is depressed into the housing to cause the boss on the actuating arm to actuate the membrane switch, the plunger flexes the leaf spring out of the rest position to a point at which the spring snaps back to the rest position thereby providing a tactile feeling in the operation of the switch.

2. A keyboard switch according to claim 1, wherein the housing further comprises a flexible stop means engaging said plunger for retaining the plunger in the housing against the bias of the resilient means.

3. A keyboard switch according to claim 2 wherein the plunger has a portion exhibiting a tapered plane which engages said flexible stop means when the plunger is in a rest position.

4. A keyboard switch according to claim 1, wherein the plunger has a portion exhibiting a tapered plane which engages the housing when the plunger is in a rest position for retaining the plunger in the housing against the bias of the resilient means.

5. A keyboard switch according to claim 1 wherein the snap action of the leaf spring is adapted to cause the leaf spring to strike the housing and produce a click sound.

6. A keyboard switch according to claim 5, wherein a mid-section of the leaf spring has a projection engaging said housing to decrease the clock sound.

7. A keyboard switch according to claim 1, wherein the leaf spring is so mounted to the housing that the leaf spring does not strike the housing during the snap action of the spring thereby to avoid the production of a click sound.

8. A keyboard switch according to claim 1, wherein the actuating arm is pivoted to the housing by at least one shaft located in a "C" shaped slot of the housing.

9. A keyboard switch according to claim 1, wherein the housing has a plurality of externally mounted hooks to enable the housing to be mounted to a support structure.

10. A keyboard switch according to claim 1, wherein the resilient means comprises a compression spring extending between facing seats on the plunger and the first portion of the actuating arm respectively.

11. A membrane switch assembly having:

at least one membrane switch and:

a keyboard switch for actuating the membrane switch, said keyboard switch comprising:

a housing positioned, in use, on said membrane switch;

a plunger mounted for reciprocal movement within the housing and projecting outwardly from the housing, the plunger having an exterior wall with a single cam portion extending outwardly therefrom normal to the direction of movement of the plunger, said cam portion having a generally rectangular camming surface, when viewed normal to the direction of movement of the plunger, with one dimension of said surface lying parallel to said direction of movement;

an actuating arm pivoted to the housing and having a first portion extending beneath the plunger, said actuating arm having a second portion having a single cam follower which engages said single cam portion of the plunger during both directions of the reciprocal movement of said plunger, the first portion having a boss on its surface facing away from the plunger for engaging the membrane switch;

resilient means extending between the plunger and the first portion of the actuating arm to urge the plunger outwardly from the housing; and a leaf spring mounted to the housing, said leaf spring having a rest position within said housing and a portion which normally engages the plunger; the arrangement being such that when the plunger is depressed into the housing to cause the boss of the actuating arm to actuate the membrane switch, the plunger flexes the leaf spring out of the rest position to a point at which the spring snaps thereafter back to a rest position thereby providing a tactile feeling in the operation of the switch.

* * * * *